US009630763B2

(12) United States Patent
Lituchy

(10) Patent No.: US 9,630,763 B2
(45) Date of Patent: Apr. 25, 2017

(54) STORAGE CONTAINER WITH VACUUM

(71) Applicant: Andrew E Lituchy, Roslyn Heights, NY (US)

(72) Inventor: Andrew E Lituchy, Roslyn Heights, NY (US)

( * ) Notice: Subject to any disclaimer, the term of this patent is extended or adjusted under 35 U.S.C. 154(b) by 0 days.

(21) Appl. No.: 14/547,091

(22) Filed: Nov. 18, 2014

(65) Prior Publication Data

US 2015/0071570 A1 Mar. 12, 2015

Related U.S. Application Data

(63) Continuation-in-part of application No. 12/954,062, filed on Nov. 24, 2010, now abandoned.

(51) Int. Cl.
*B65D 81/00* (2006.01)
*B65D 81/20* (2006.01)

(52) U.S. Cl.
CPC ..... *B65D 81/2038* (2013.01)

(58) Field of Classification Search
CPC ..... B65D 81/2038; B65D 81/2023; B65D 31/047; B65D 77/225; A01K 97/08
USPC ..... 383/100, 103, 44, 45, 49, 58
See application file for complete search history.

(56) References Cited

U.S. PATENT DOCUMENTS

| | | | | | |
|---|---|---|---|---|---|
| 2,669,176 | A * | 2/1954 | Lazerus | 99/472 |
| 2,913,030 | A * | 11/1959 | Fisher | 206/317 |
| 3,980,226 | A * | 9/1976 | Franz | 383/71 |
| 4,712,249 | A * | 12/1987 | Gannon | 383/43 |
| 5,142,970 | A * | 9/1992 | ErkenBrack | 99/472 |
| D338,399 | S * | 8/1993 | Conte, Jr. | D9/709 |
| 5,261,532 | A * | 11/1993 | Fauci | 206/218 |
| 5,450,963 | A * | 9/1995 | Carson | 206/524.8 |
| 5,839,582 | A * | 11/1998 | Strong et al. | 206/524.8 |
| 5,881,881 | A * | 3/1999 | Carrington | 206/524.8 |
| 6,675,982 | B2 * | 1/2004 | Heil et al. | 220/212 |
| 7,597,479 | B2 * | 10/2009 | Zimmerman et al. | 383/103 |
| 7,614,430 | B2 * | 11/2009 | Bergman et al. | 141/8 |
| 8,112,971 | B2 * | 2/2012 | Newrones et al. | 53/405 |
| 2005/0172577 | A1 * | 8/2005 | Oltrogge | 53/434 |
| 2007/0034542 | A1 * | 2/2007 | Cerreta | 206/524.8 |
| 2008/0159660 | A1 * | 7/2008 | Roell, III | 383/40 |
| 2012/0027323 | A1 * | 2/2012 | Vitallo et al. | 383/100 |

* cited by examiner

*Primary Examiner* — Peter Helvey
(74) *Attorney, Agent, or Firm* — Locke Lord LLP

(57) ABSTRACT

A device comprises an upper section with a unidirectional flow valve and a lower section with a surface for adhering to a container with its own unidirectional flow valve and a passageway to circumscribe the container's unidirectional flow valve. A middle section of the device has a plurality of walls of which some may be at substantially acute angles that couple the upper section to the lower section to form a cavity between the unidirectional flow valve and the passageway.

20 Claims, 13 Drawing Sheets

FIG. 11A
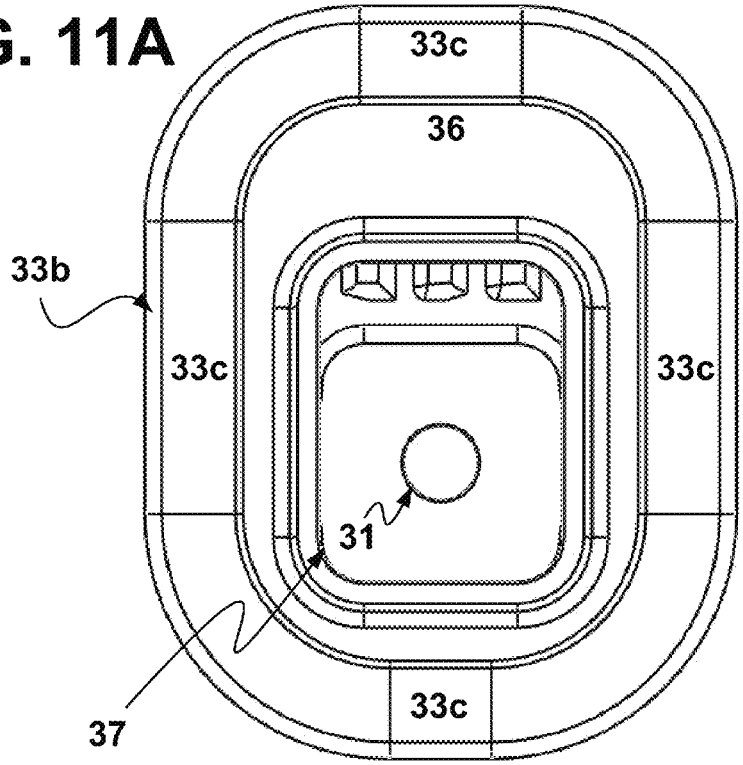
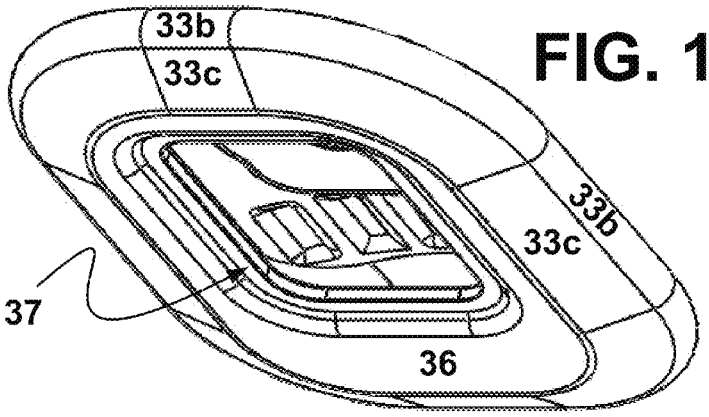
FIG. 11B

STORAGE CONTAINER WITH VACUUM

RELATED PATENT APPLICATIONS

This application is a continuation-in-part of U.S. patent application Ser. No. 12/954,062, filed Nov. 24, 2010, the entire contents of which being incorporated herein by reference in their entirety.

FIELD OF THE INVENTION

Disclosed are embodiments of the invention which relate to, among other things, vacuum air-removal from storage containers.

BACKGROUND

Convenient removal of air from storage containers, such as, for example, plastic food storage bags, helps prevent spoliation of the contents remaining therein for long periods of time.

Reliance on equipment that must be separated from storage containers after attempting to vacuum seal the same is cumbersome and costly to consumers and manufacturers.

SUMMARY OF THE INVENTION

Vacuum sealing of a storage container may take place via a device comprising a first unidirectional flow valve coupled to a substantially air-tight container, a second unidirectional flow valve and an elastically resilient wall completely circumscribing flow from the first unidirectional flow valve to the second unidirectional flow valve. Intermittent application of pressure to the wall removes air from the storage container.

A device may have an upper section having a unidirectional flow valve disposed therein and a lower section having at least one surface configured for adhering to a container comprising a container unidirectional flow valve, the lower section also having a passageway through its thickness shaped to circumscribe the container unidirectional flow valve; and a middle section comprised of a plurality of walls, of which two of the plurality are joined at a substantially acute angle, the middle section coupling the upper section to the lower section to form a cavity between the unidirectional flow valve and the passageway.

Vacuum sealing of a food storage container may be effected via a device comprising a first unidirectional flow valve coupled to a food storage container, a second unidirectional flow valve and an elastically resilient chamber coupling the first unidirectional flow valve to the second unidirectional flow valve, wherein intermittent application of pressure to the chamber removes air from the food storage bag.

BRIEF DESCRIPTION OF THE DRAWINGS

FIGS. 10A, 10B, 11A, 11B, and 14B illustrate a plurality of views of another vacuum air-removal mechanism according to other exemplary embodiments of the present invention.

In the drawings like characters of reference indicate corresponding and interchangeable parts in the different figures.

DETAILED DESCRIPTION

Figure 1:
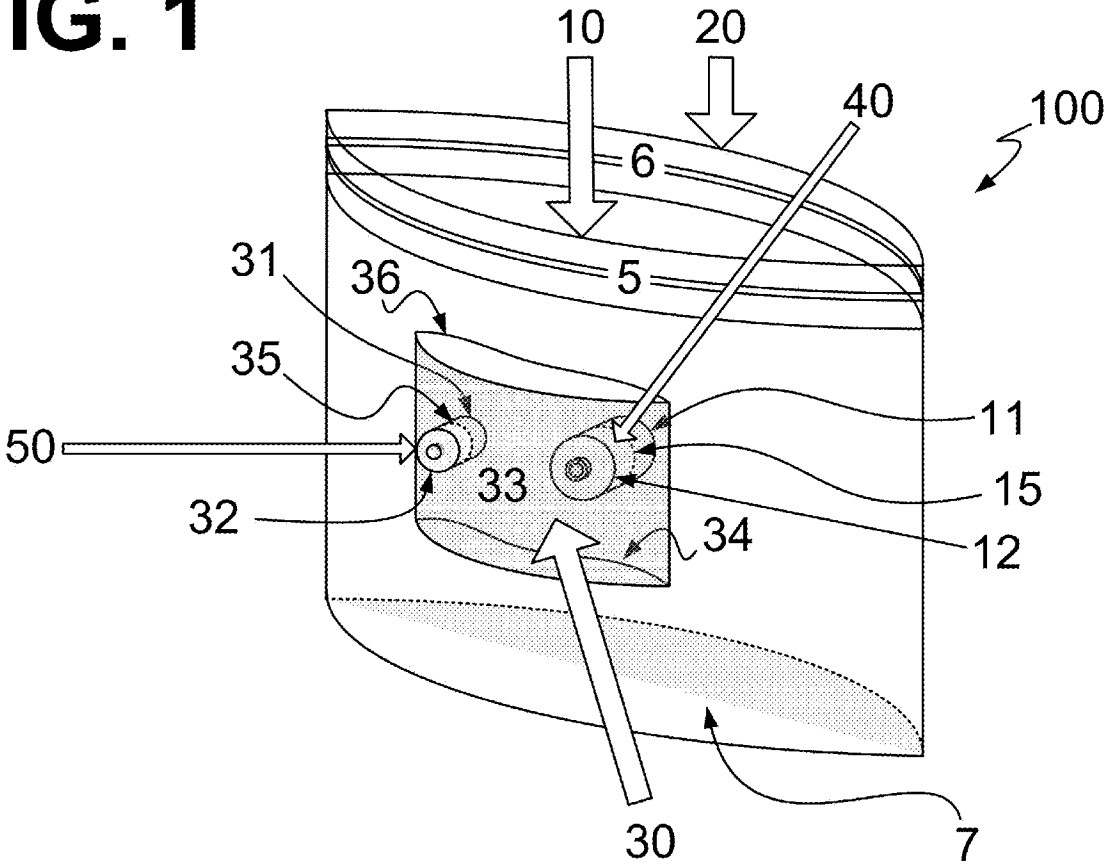
FIG. 1 illustrates a storage container with a vacuum according to an exemplary embodiment of the present invention.

FIG. 1 illustrates a vacuum storage container 100 which may comprise a container 7 with sides 10 and 20. In one embodiment, the container 7 of the vacuum storage container 100 may be a plastic storage bag, such as, for example, a Ziploc® storage bag. Alternatively, such a container may be made of aluminum foil, cling wrap, plastic, fabric, Mylar® or paper. A container 7 may have at least edges 5 and 6 which, when in contact with one another, permit substantially no air loss from within the volume encompassed between sides 10 and 20. Where the container 7 of vacuum storage container 100 is a Ziploc® bag, the zipping portions of the bag (e.g., portions 5 and 6 of an exemplary container 7) may seal air between the walls formed by the opposing pieces of plastic making up the bag (e.g., sides 10 and 20 of an exemplary container 7). Container 7 may be fabricated according to any means known to those skilled in the art.

According to one embodiment of FIG. 1, vacuum chamber 30 is integrated with the outer wall 10 of container 7. Vacuum chamber 30 may have an outer surface 33 that intersects the surface 10 of container 7 at section 36. Section 36 may be the site of any type of substantially air-tight seal between a surface of container 7 and material comprising vacuum chamber 30 that may be effected by means known to those skilled in the art, such as, for example, heat molding, application of adhesive(s), chemical bonding, welding, etc. Vacuum chamber 30 may have a thickness defined by the material between inner surface 34 and outer surface 33. Vacuum chamber 30 may be made out of any resilient material possessing elasticity to substantially return to a previous expanded volume upon application and release of pressure on its surface 33, e.g., shape memory plastic, rubber.

Referring again to FIG. 1, air located between sealed walls 10 and 20 of container 7 communicates with the space under surface 33 of vacuum chamber 30 via a one-way gas flow valve 40 integrated into the wall 10 of container 7. Air under surface 33 of vacuum chamber 30 communicates with the ambient via another one-way gas flow valve 50. Flow valves of this type and function are known to those skilled in the art, for example, those of the type disclosed in U.S. Pat. No. 5,450,963, the disclosures of which are incorporated herein by reference in their entirety. Although the illustrated embodiments show a particular number of flow valves 40/50, the present invention may make use of any number of gas flow valves 40 and 50 depending on the needs and uses of the vacuum storage container 100.

In an exemplary flow valve arrangement according to FIG. 1, a gas inlet 11 of flow valve 40 may only be in contact with air within sealed container 7 (e.g., inside of wall 10). A valve integration region 15 is the area around which container 7 holds flow valve 40. Gas exit 12 of flow valve 40 may only be in contact with the space under surface 33 of vacuum chamber 30. The air in vacuum chamber 30 may only be in contact with inlet 31 of flow valve 50. Valve integration region 35 may be the area around which vacuum chamber 30 holds flow valve 50. Finally, valve exit 32 may only be in contact with the ambient air outside of sealed container 7. Those skilled in the art would recognize that the size, shape, orientation and locations of the portions of flow valves 40 and 50 may be modified to accommodate any particular container or vacuum chamber according to the desired need. For example, in storing liquids, it may be preferable to place flow valve 40 near the opening of container 7 so as to avoid contact with the liquid gas when removing air from the container 7. Alternatively, the gas inlets and outlets of the flow valves may be flush with the walls of the material in which they are integrated.

Figure 2:
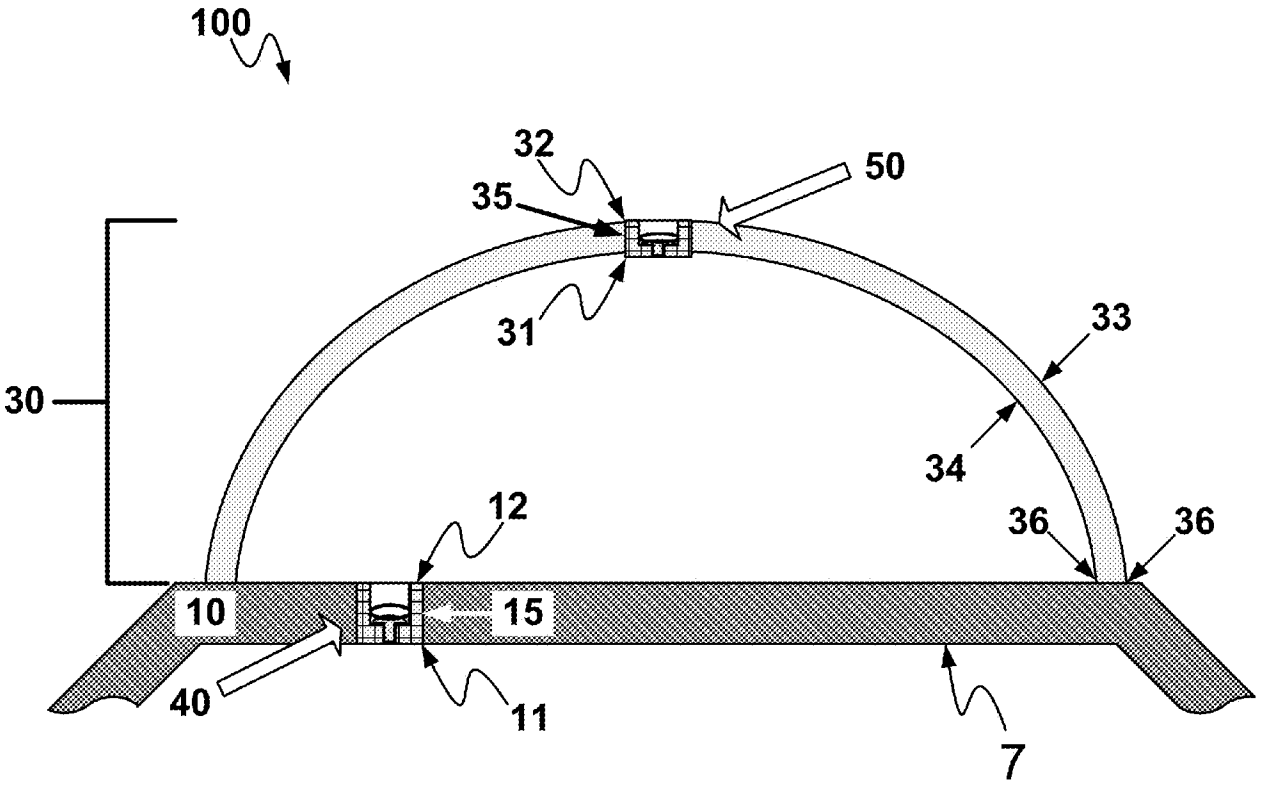
FIG. 2 illustrates one profile view of a storage container with a vacuum according to an exemplary embodiment of the present invention.

FIG. 2 illustrates a profile view of the vacuum storage container 100 according to another exemplary embodiment of the present invention. Wall 10 of container 7 is shown with flow valve 40 extending through its surface. Surface 11 is flush with the inside of wall 10 while a region of the flow valve 40, integration region 15, is integrated with wall 10 so as not to permit substantial losses of air other than through flow valve 40. Integration region 15 may be molded within the thickness of wall 10 by any means known to those skilled in the art. Exit 12 of flow valve 40 opens into space surrounded by surface 34 of vacuum chamber 30. Air-flow through valve 40 may remain within inner surface 34 of vacuum chamber 30 until pressure is applied to outer surface 33 of vacuum chamber 30. Such pressure would move air under surface 34 through at least one flow valve 50. Prior to application of pressure on surface 33, air within vacuum chamber 30 may remain substantially near inlet 31 of flow valve 50. Once pressure is applied to surface 33 of vacuum chamber 30, air-flows through the inlet 31 and out of vacuum chamber 30 at flow valve exit 32 of flow valve 50. Like flow valve 40, flow valve 50 may be integrated within the thickness between inner surface 34 and outer surface 33 of vacuum chamber 30 by any means known to those skilled in the art.

Figure 3:
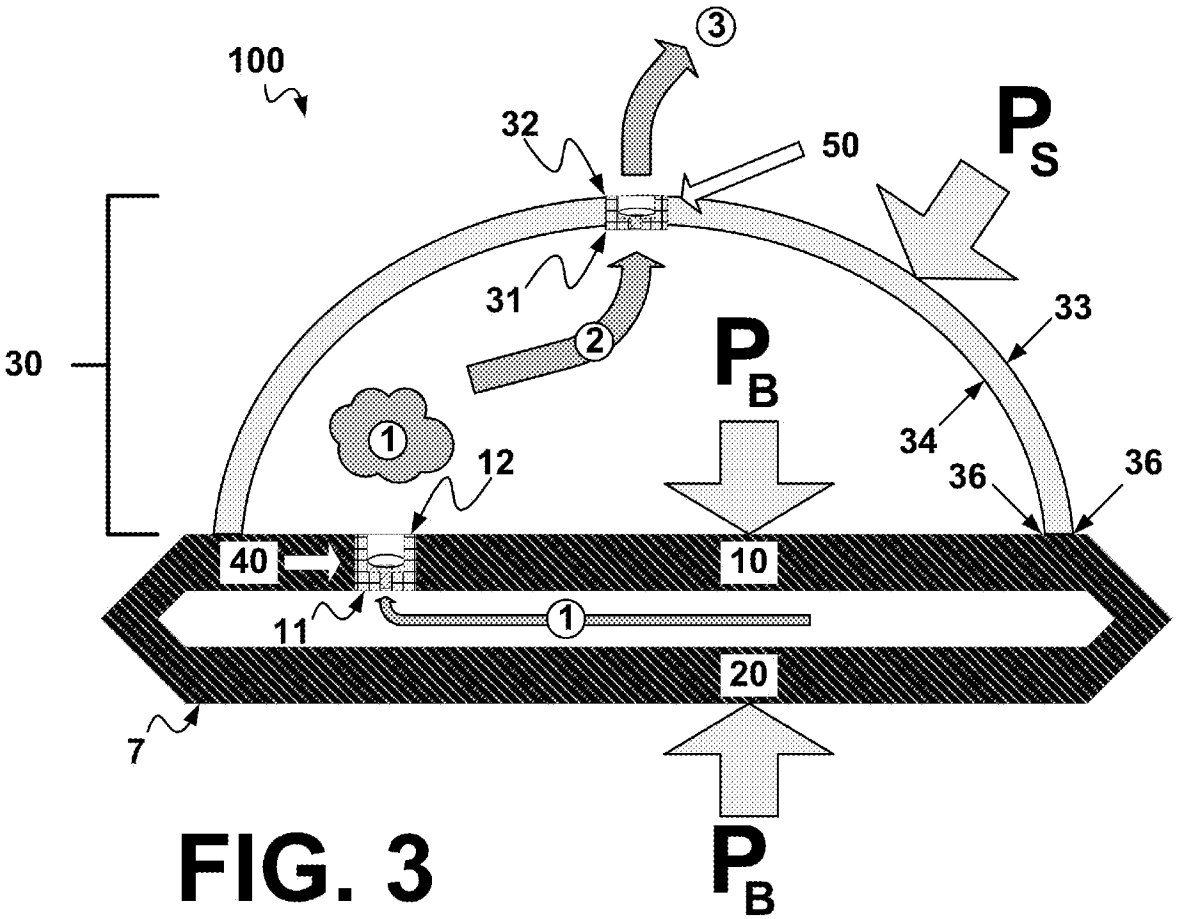
FIG. 3 illustrates operation of a storage container with a vacuum according to an exemplary embodiment of the present invention.

FIG. 3 illustrates one exemplary form of operation of the present invention. According to the illustrative embodiment of FIG. 3, pressure ($P_B$) applied to container 7 on wall 10 and/or 20 may cause air 1 to enter flow valve 40 and exit into vacuum chamber 30. Air 1 will remain in vacuum chamber 30 until sufficient pressure ($P_S$) is generated either externally on surface 33 or internally by surface 34. When an external pressure $P_S$ is applied, air 1 will be forced into an exit stream 2 through flow valve 50 and into ambient 3. When vacuum chamber 30 reaches maximum capacity under surface 34, the resiliency of vacuum chamber 30's material may put pressure $P_S$ on any existing air 1 to force any additional air 2 through flow valve 50 and into the ambient 3. According to this embodiment, vacuum storage container 100 functions with pressures applied to both the container walls 10 and/or 20 and the vacuum chamber 30. A combination of these applied pressures may further seal container 7 to achieve optimal air-tight sealing of the contents therein, e.g., creation of a vacuum within container 7 further causes sealing of walls 10 and/or 20 and/or edges 5/6.

Figure 4:
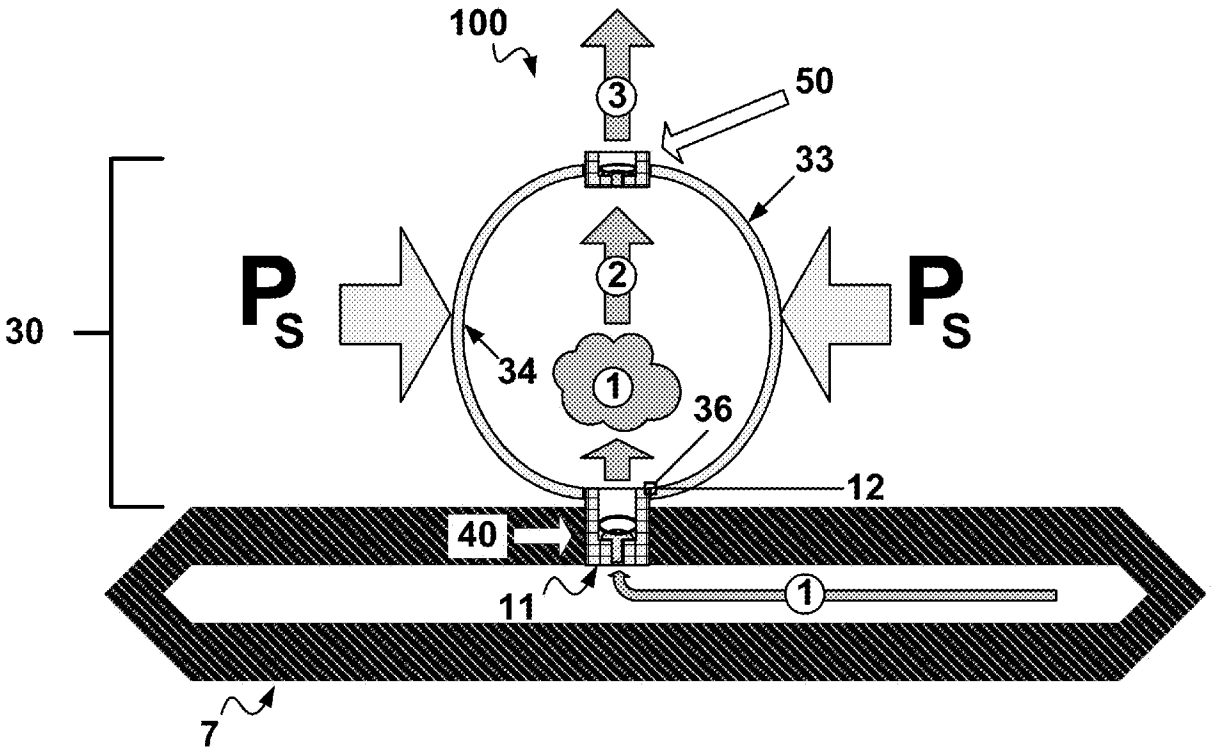
FIG. 4 illustrates another profile view of a storage container with a vacuum and operation of the same according to an exemplary embodiment of the present invention.

In the illustrative embodiment of the present invention according to FIG. 4, application of external pressure $P_S$ on surface 33 of vacuum chamber 30 moves whatever pre-existing air 1 volume within vacuum chamber 30 out of flow valve 50 and into the ambient 3. As the resilient material of vacuum chamber 30 allows surface 33 to revert to its original shape and allow vacuum chamber 30 to substantially regain its prior volume (e.g., space under surface 34 before application of external pressure $P_S$), air 1 from within the sealed walls 10 and 20 of container 7 is drawn through flow valve 40 and into vacuum chamber 30. By repeating the same application and removal of external pressure to surface 33 of vacuum chamber 30, vacuum chamber 30 will remove air 1 from within container 7 and place it into the ambient 3. According to this embodiment, vacuum chamber 30 is integrated with any region of flow valve 40 apart from wall 10 of container 7 (e.g., surface of flow valve 40 from integration region 15 to valve exit 12) such that section 36 and a portion of flow valve 40 are coupled so that substantially no air may be lost during intermittent pressure application to vacuum chamber 30. Repetition of application and removal of pressure to vacuum chamber 30 may also serve to tighten the seal in container 7 thereby increasing the substantial air-tight seal previously used to substantially enclose air 1 within the walls and/or edges of container 7.

The illustrative embodiment of the present invention depicted in FIG. 4 may be fabricated by molding or sealing the vacuum chamber 30 material about a flow valve 50 and the external portions of flow valve 40 (e.g., surface of flow valve 40 from integration region 15 to valve exit 12). The remaining surface of flow valve 40 not connected to vacuum chamber 30 may be similarly integrated with a container 7 using known processes in the art. Those skilled in the art may recognize other forms of substantial air-tight coupling which may be used in any of the aforementioned fabrication processes, such as, but not limited to, molding, adhering, welding, or chemical bonding.

Figure 5:
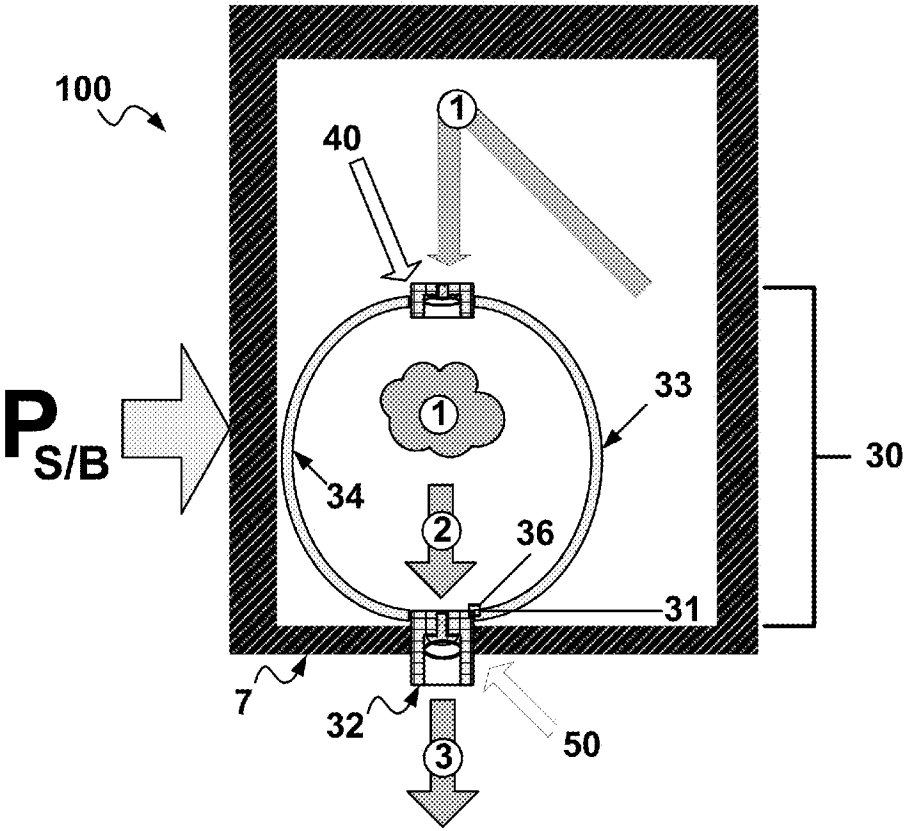
FIG. 5 illustrates yet another profile view of a storage container with a vacuum and operation of the same according to exemplary embodiments of the present invention.

FIG. 5 illustrates an alternative embodiment wherein the vacuum chamber 30 is disposed inside sealed container 7. As similarly described with respect to the operation of the exemplary embodiment illustrated in FIG. 4, compression on surface 33, by virtue of pressure $P_{S/B}$ being placed on a wall of container 7, causes vacuum chamber 30 to expel air 1 located therein by moving air 1 in a stream of air 2 through flow valve 50 out of container 7 and into ambient 3. As inner surface 34 of vacuum chamber 30 substantially regains its prior size and volume, air 1 from within container 7 is brought through flow valve 40 and inside vacuum chamber 30 where it cannot exit back into container 7. According to this embodiment, vacuum chamber 30's internal positioning reduces the overall size of vacuum storage container 100. Similar to the exemplary embodiments illustrated with respect to FIG. 4, repeated application and removal of pressure to vacuum chamber 30 may also tighten the air seal of the walls and/or edges of container 7.

Figure 6:
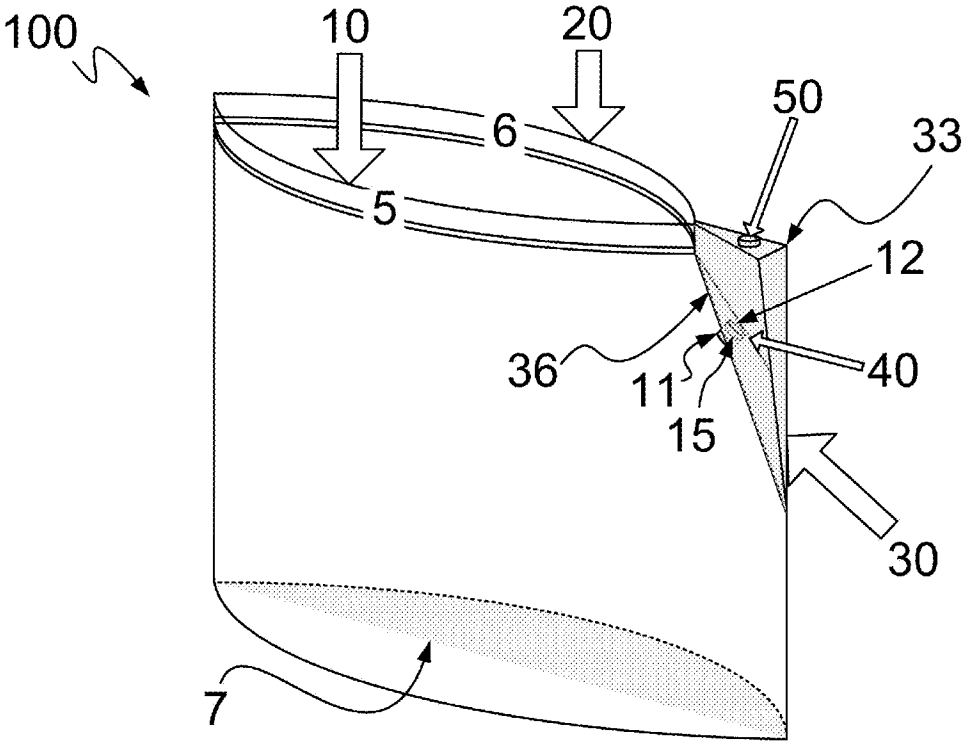
FIG. 6 illustrates another storage container with a vacuum according to an exemplary embodiment of the present invention.

Referring to FIG. 6, vacuum chamber 30 may be integrated with container 7 in a way which does not substantially add to container 7's shape and size. FIG. 6 illustrates an embodiment of the invention where vacuum chamber 30 makes up a corner of container 7 but otherwise does not impede the sealing of container 7's walls 10 and 20 at edges 5 and 6. As previously described, vacuum chamber 30 is integrated with container 7 at section 36 (e.g., by molding, chemical bonding, adhesives). In similar fashion to FIGS. 1-3, valves 40 and 50 are integrated (e.g., at integration region 15 and 35 respectfully) to allow for air to be transferred from within container 7 into vacuum chamber 30 (from valve 40 surface 11 through valve 40 exit 12) and from vacuum chamber 30 to the ambient (from valve 50 surface 31 through valve 50 exit 32). As shown in FIG. 6, surface 33 of vacuum chamber 30 may be shaped to appear as the corner of container 7. It is also envisioned that surface 33 may be shaped in any fashion to comply with container 7's pre-vacuum chamber appearance. In this way the benefits and advantages of vacuum chamber 30 may be enjoyed without loss of the normal operation of container 7. Fabrication of vacuum chambers 30 of the type depicted in FIG. 6 may be achieved in like fashion to those methods described previously with reference to the other exemplary embodiments of the present invention.

Figure 8:
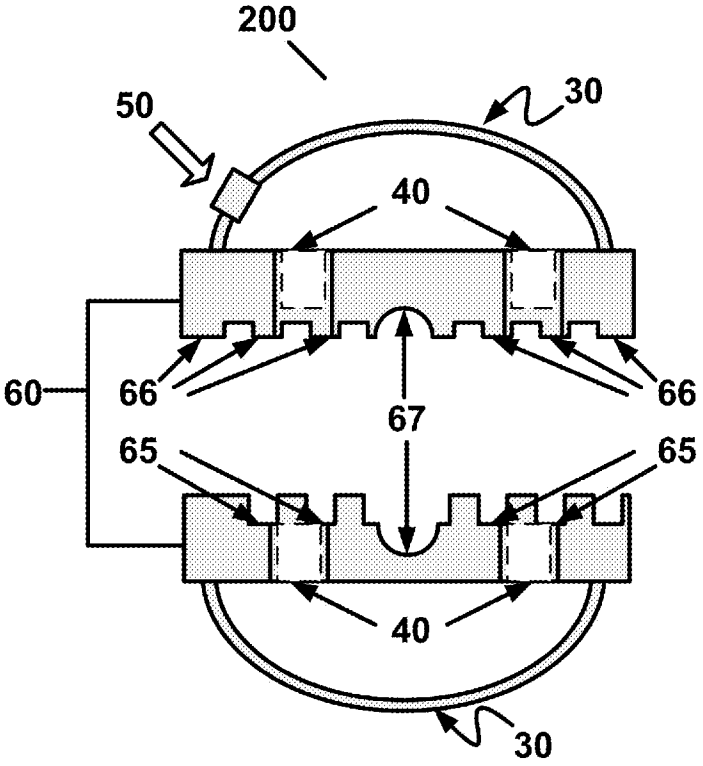
FIGS. 7 and 8 illustrate vacuum air-removal mechanisms according to other exemplary embodiments of the present invention.
Figure 7:
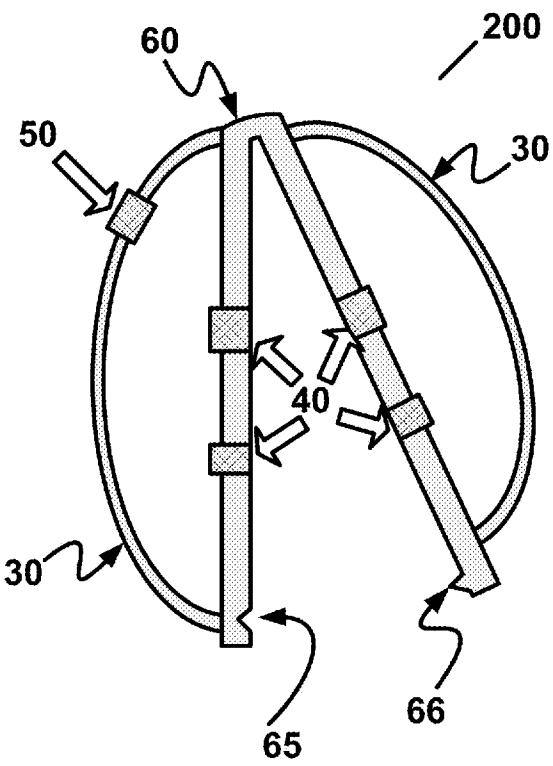

FIGS. 7 and 8 illustrate a vacuum mechanism 200 for use on storage containers. In an exemplary embodiment of the present invention, a vacuum mechanism 200 may comprise a clamp 60 whose interlocking edges 65 and 66 create substantially air-tight conditions within an interior cavity of claim 60. At least one air-flow space 67 may be provided to allow air from within a clamped container 7 to exit into the otherwise substantially air-tight cavity of clamp 60. Interlocking edges 65 and 66 may be molded in a complementary manner to substantially reduce the risk of air loss around air-flow space 67 when clamp 60 is clamped on container 7. Flow valves 40 may be disposed on either jaw of clamp 60 so as to allow any available air-flowing from a container 7 to flow there through. Integrated on either clamp jaw may be at least one vacuum chamber 30 whose wall contains a flow valve 50 permitting air within vacuum chamber 30 to only exit out of the substantially air-tight cavity formed by sealed clamp 60. Operating a vacuum chamber 30 according to the exemplary methods of operation of the illustrative embodiments described with respect to FIGS. 3 and 4 above, vacuum mechanism 200 may be used to remove air from a container 7 on which it is clamped.

Figure 9:
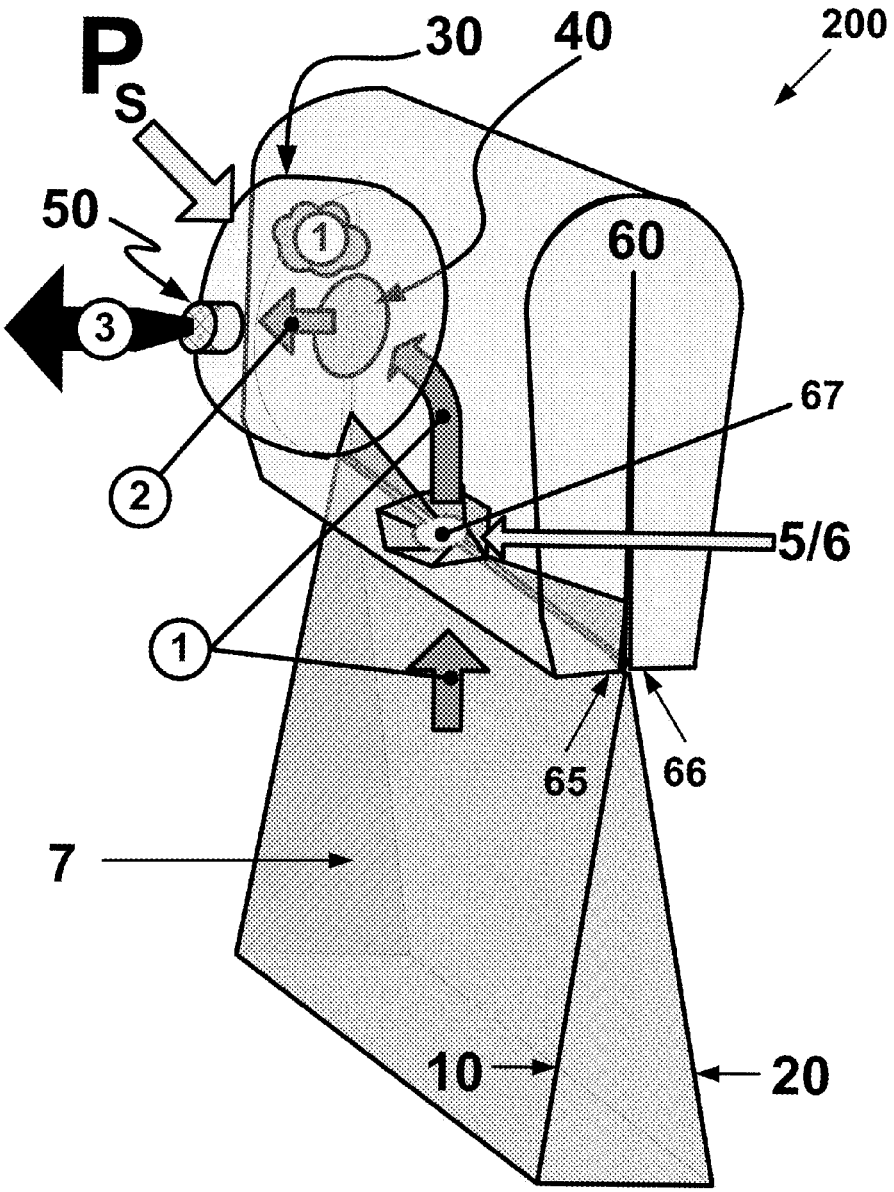
FIG. 9 illustrates another vacuum air-removal mechanism according to other exemplary embodiments of the present invention.

FIG. 9 illustrates another exemplary embodiment of a vacuum mechanism 200 for use on storage containers according to the present invention. As depicted, a clamp 60 may lock container 7 within its edges 65 and 66 such that the interior space of clamp 60 is substantially air-tight. The interlocking clamp 60 edges, 65 and 66, may provide an air-flow space 67 which edges 5/6 of container 7 are able to remain open to allow gas communication between container 7 and the interior of clamp 60. Unidirectional flow valve 40 may permit air trapped within clamp 60/container 7 to flow into vacuum chamber 30 according to the exemplary operating methods described above with respect to the illustrative embodiments of the present invention depicted in FIGS. 3 and 4. In similar fashion to previously described embodiments, application of pressure $P_S$ to the outer surface of vacuum chamber 30 may push pre-existing air 1 located in vacuum chamber 30 through unidirectional valve 50. The stream of air 2 may only be able to exit through valve 50 into the ambient 3. As vacuum chamber 30 regains its pre-existing volume, air 1 from within container 7 and/or clamp 60 fills the now vacant space within the volume of vacuum chamber 30 (e.g., by way of vacuum effect). Continued repetition of application of pressure to vacuum chamber 30 thereby removes the remaining air 1 located within container 7.

An exemplary clamp 60 according the embodiments of vacuum mechanism 200 depicted in FIGS. 7-9 may be fabricated from any suitable material with the ability to maintain substantially air-tight seals. Those skilled in the art would recognize numerous materials and constructs capable of fulfilling the objectives of clamp 60 according to the exemplary embodiments of the present invention depicted in FIGS. 7-9.

In another exemplary embodiment, and as previously disclosed, vacuum chamber 30 may be illustrated in FIGS. 10A-B, 11A-B, 12A-B, 13 and 14A-B. An exemplary vacuum chamber 30 may be a single blow-molded construct having a fold which may be operated upon to flex in an accordion-like manner to compress the volume under the chamber to exhaust gas found therein. An exemplary material for such an exemplary vacuum chamber 30 may be an elastically resilient material, such as an elastomer, preferably low density polyethylene, silicone, or rubber. The use of at least one elastically resilient fold may also expand the chamber volume to intake gas from a storage container 7 equipped with a gas valve, e.g. a one-way valve 40. While a unitary blow molded construct may be a preferred construction, a multicomponent construct may be utilized by persons skilled in the art to achieve an exemplary vacuum chamber 30, e.g., overlapping layers/folds of material bonded or otherwise mechanically or chemically attached to adjacent layers/folds.

Figure 10A:
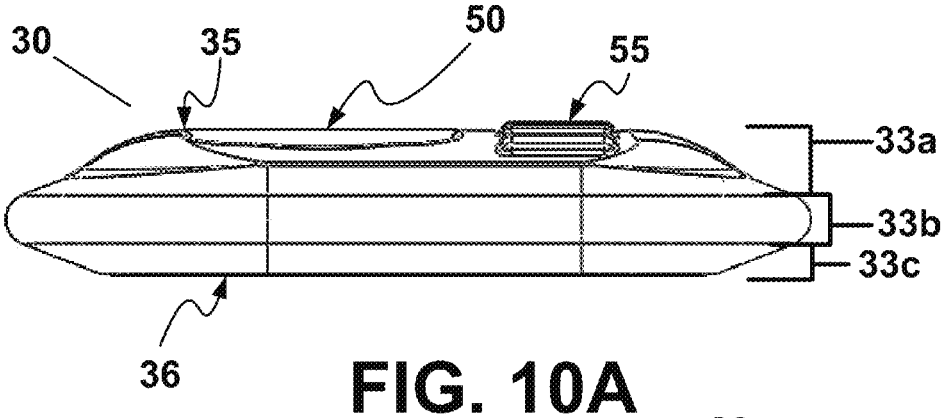
Figure 10B:
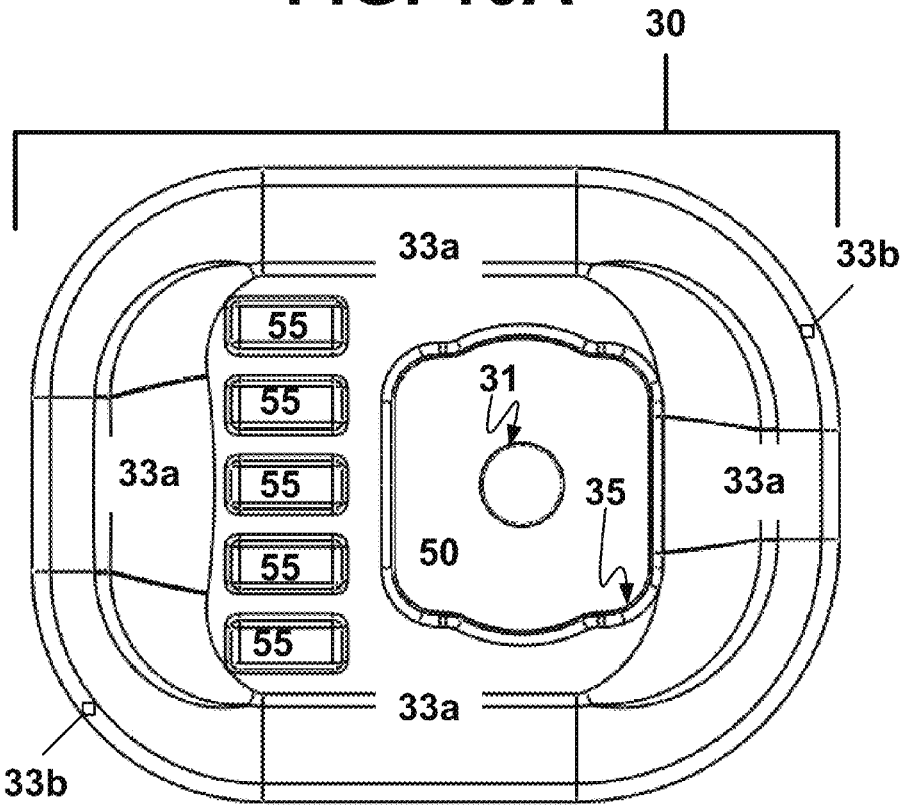

According to the illustrative embodiment of FIGS. 10A and 10B, an exemplary vacuum chamber 30 may comprise a storage container contact or junction portion 36, a one-way exhaust valve 50, and a plurality of surface sections 33*a*-33*c*. While valve 50 may take the form of any suitable one-way valve, as previously disclosed, valve 50 may be substantially flat or small in construction. In a preferred embodiment, valve 50 may be a substantially rectangular plastic laminate sticker made by Plitek, LLC of Des Plaines, Ill. Accordingly, valve 50 may be coupled to vacuum chamber 30 at seat region 35. To assist in the compression and expansion of chamber 30 according to these embodiments, pads 55 may be disposed on one or more of the surface sections 33*a-c*, preferably on upper section 33*a*.

As illustrated in FIGS. 10A and 10B, an exemplary vacuum chamber 30 may be substantially rectangular in shape, although other shapes may be possible, such as elliptical, circular, square, pyramidal, or other such polyhedrons. In one embodiment, vacuum chamber 30 may have a discus-like shape. Alternatively, a vacuum chamber 30 may be hexagonal in cross-section. For an exemplary vacuum chamber 30 according to the illustrative embodiments of FIGS. 10A and 10B, such a chamber 30 may be made up of at least an upper surface section 33*a* on which the one way valve 50 is disposed, a middle surface section 33*b*, and a lower surface section 33*c*. In an exemplary embodiment, middle surface section 33*b* and lower surface section 33*c* contain flexible zones, e.g., lengths that are elastically resilient, that react to pressure forces on upper surface section 33*a*. Thus, in an exemplary embodiment, surface section 33*a* may be stiffer than middle surface section 33*b* and lower surface section 33*c*. Alternatively, all surface sections 33*a-c* may have the same flexibility to allow vacuum chamber 30 to function. A junction surface 36 provides a coupling between chamber 30 and the storage container surface 7 (not shown in FIGS. 10A-10B). As previously disclosed, junction surface 36 may be an adhesive or an integral portion of the storage container surface 7. While junction surface 36 may contain adhesive on it to allow for reversible coupling to storage container surface 7, junction surface 36 may couple to storage container surface 7 without adhesives or it may use any other chemical or mechanical fastening means. Furthermore, junction surface 36 may be coupled to the storage container by any means, known to those skilled in the art, such as suction couplings or Velcro, or as otherwise described herein.

As further shown in FIG. 10B, upper surface section 33*a* may contain numerous curved surfaces and recesses. A preferred recess in section 33*a* may be seat region 35 to which a suitable one-way valve 50 may be coupled. Further provided in section 33*a* is an outlet 31 connecting the interior volume of vacuum chamber 30 to one-way valve 50.

With reference to FIG. 11A, an exemplary vacuum chamber 30 may be viewed so that junction surface 36 is facing the viewer and the lower surface section 33*c* and middle surface section 33*b* are visible. Through passageway 37, vacuum chamber 30 allows access of gas from the one-way valve 40 (not shown) on storage container 7 (not shown). Passageway 37 may be shaped and sized to allow limited or variable placement about an exemplary one-way valve 40 of an exemplary storage container 7. Passageway 37 may be configured so as to place the one-way valve 40 of the storage container 7 directly underneath the hole 31 providing gas passage to one-way valve 50 of vacuum chamber 30. FIG. 11B shows another view of the lower surface section 33*c*, juncture surface 36, and middle surface section 33*b*. Further illustrations of such an exemplary vacuum chamber may be seen in FIG. 14B.

Figure 12A:
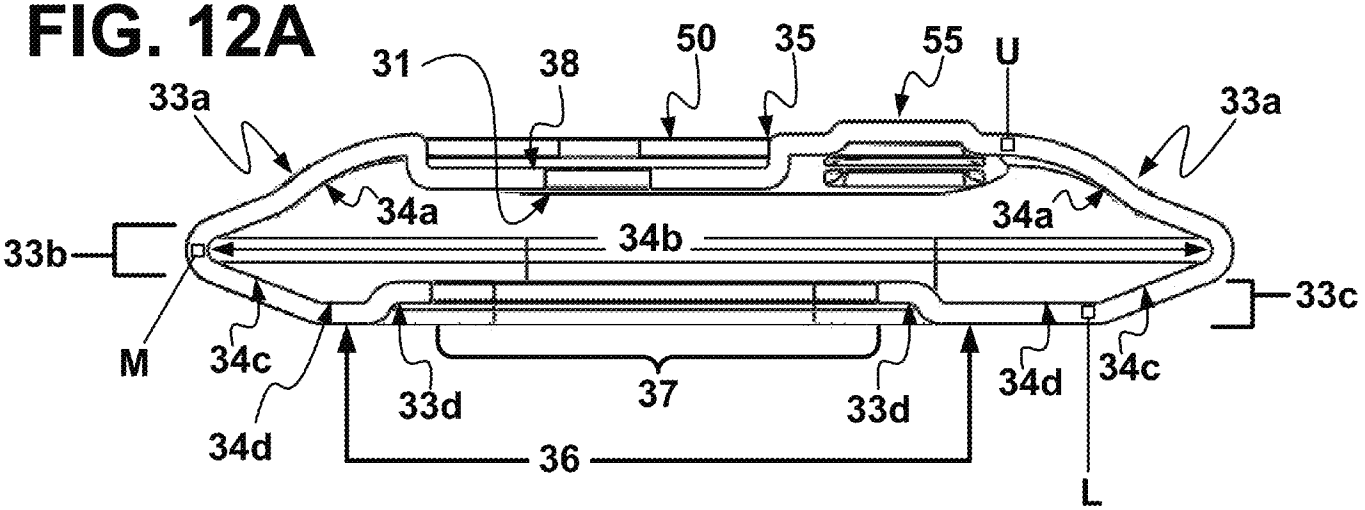
FIGS. 12A and 12B illustrate a profile view of a vacuum air-removal mechanism according to other exemplary embodiments of the present invention.
Figure 12B:
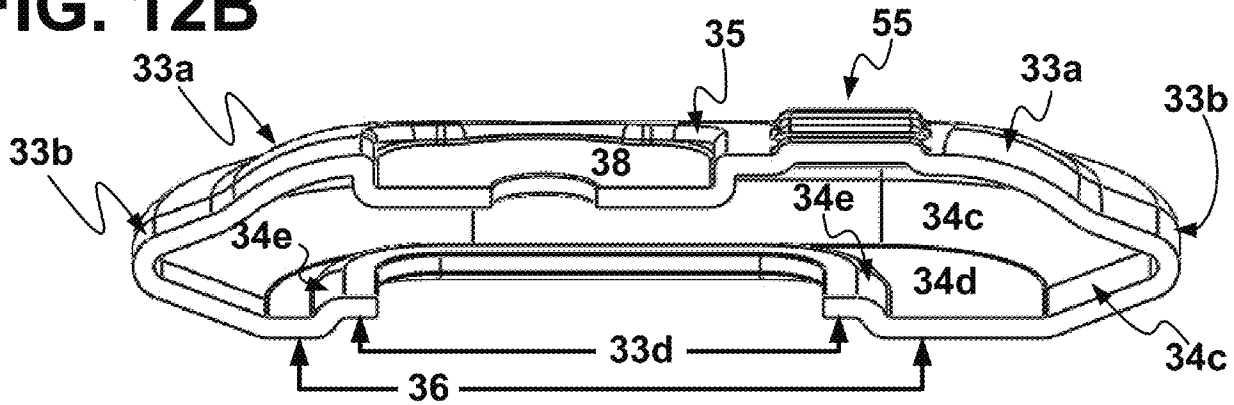

In an exemplary cross-section of an exemplary vacuum chamber 30, FIGS. 12A and 12B may be illustrative embodiments of the internal structures of said vacuum chamber 30. With reference to FIG. 12A, vacuum chamber 30 comprises an upper surface section 33*a* that has a seat 35 and pocket 38 to which a one-way valve 50 couples. As situated, one-way valve 50 extracts gas from the volume within vacuum chamber 30 through hole 31. Also atop upper surface section 33*a* may be a plurality of pads 55. Further illustrations of such an exemplary vacuum chamber may be seen in FIGS. 14A-B.

Figure 14A:
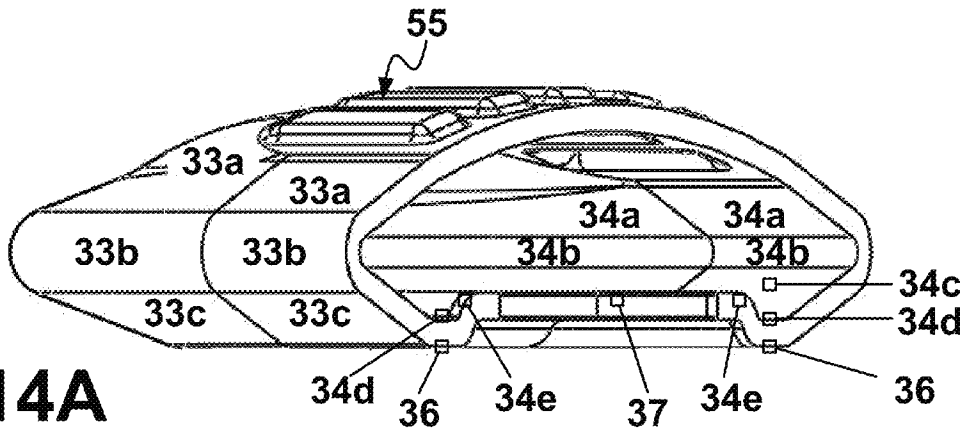
FIG. 14A illustrates a further view of a vacuum air-removal mechanism according to other exemplary embodiments of the present invention.
Figure 14B:
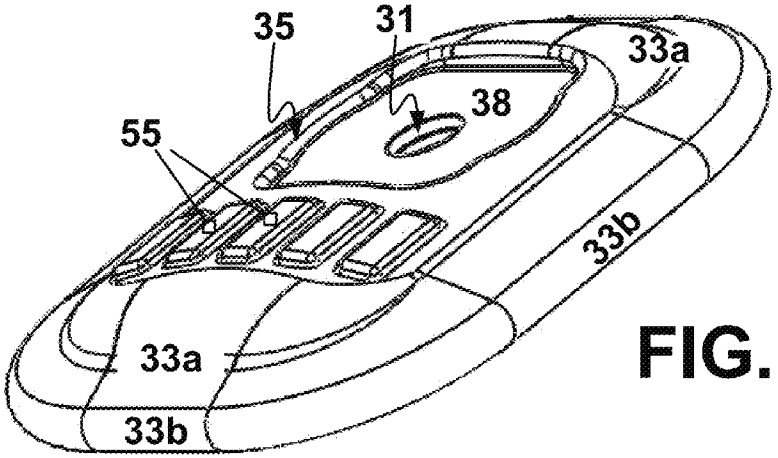

As illustrated in FIGS. 12A and 12B and further illustrated in FIGS. 14A and 14B, upper surface section 33*a* may be bounded by upper inside section 34*a* and between each may be an upper section wall "U". The middle surface section 33*b* may be bounded by middle inside section 34*b* and between each may be found a middle section wall "M". Lower surface section 33*c* may be bounded by lower inside section 34*c* and between each may be found a lower section wall "L". In an exemplary embodiment, upper section wall "U" is thicker than the middle section wall "M" because middle section wall may need to be more flexible and/or have more springiness during compression and to increase shape reformation during expansion. In another embodiment, middle section wall M has a higher elastic resilience than other exemplary sections of an exemplary vacuum chamber 30. In another embodiment, the size, cross-section, and material of the upper section, the middle section, and the lower section walls may be the same, substantially the same, or different from one another depending on applications. In a preferred embodiment, the following design parameters may be utilized for an exemplary vacuum chamber 30:

$U \geq L$; and $U > M$

In an even more preferred embodiment, the following design parameters may be utilized for an exemplary vacuum chamber 30:

$U \geq L$;

$U > M$ $L > M$

In an exemplary embodiment, lower surface section 33*c* may be bounded by additional surface structures, such as well surface 34*d* and step surface 34*e* before terminating at passageway 37. In an exemplary embodiment, junction surface 36 may be the bounding surface for lower surface section 33*c*. Alternatively, junction surface 36 may be the bounding surface for well surface 34*d*. In a further alternative embodiment, junction surface 36 may be the bounding surface for step surface 34*e*, as may be illustrated in FIG. 12B. An exemplary step surface 34*e* and 33*d* may be configured to permit an exemplary vacuum chamber 30 to receive any exemplary one-way valve 40 of any exemplary storage container 7.

In the illustrative embodiments of FIGS. 12A and 12B, junction surface 36 may be shaped so as to have unequal surface areas on either side of passageway 37. For example, junction surface 36 may be largest in the area of vacuum chamber 30 which holds the compression pads 55. Alternatively, junction surface 36 may be shaped so as to fit about an exemplary one-way valve 40 on a particular storage container 7. Thus, for storage containers 7 with one-way valves 40 at their corners, junction surface 36 may be configured to allow the necessary contact between vacuum chamber 30 and storage container 7 to allow the gas from below one-way valve 40 to be extracted from the one-way valve via exemplary compression and expansion steps of an exemplary vacuum chamber 30. According to this exemplary embodiment, a thinner junction surface 36 may be for the edges of the corner of storage container 7 while a larger junction surface 36 may be for the portions of storage container 7 distal of the corner and adjacent to the one-way valve 40 to be circumscribed in the passageway 37. Further illustrations of such an exemplary vacuum chamber may be seen in FIGS. 14A-B.

In the illustrative embodiments of FIGS. 12A-B and as further illustrated in FIGS. 14A-B, an exemplary middle surface section 33*b* may be a construction having an acute angle relative to one of the upper surface section 33*a* or lower surface section 33*c*. While middle surface section 33*b* may be shown as a substantially smooth wall, it may be contemplated that middle surface section 33*b* may have additional contours and surface features. As further shown by the illustrative embodiments of FIGS. 12A-B, an exemplary lower surface section 33*c* may be a construction having an obtuse angle relative to the junction surface 36. In a preferred embodiment, a combination of acute middle surface section 33*b* and obtuse lower surface section 33*c* may permit for flexible displacement of the upper surface section 33*a* of vacuum chamber 30 so as to allow vacuum chamber 30 to operate to remove gas from within an exemplary container 7 with one-way valve 40 when vacuum chamber 30 is placed about such a one-way valve.

As further illustrated in FIGS. 12A-B, an illustrative pocket 38 may preferably be a recessed space or well on the top of the vacuum chamber 30 to house an exemplary valve 50. In a further preferred embodiment, two of the sides of the pocket 38 may have curved and/or arched edges 35 to allow flow out of the valve 50. Accordingly, pocket 38 with curved and/or arched edges 35 may direct flow in two directions and through a channel created by valve 50, for example, a laminate valve 50. Further illustrations of such an exemplary vacuum chamber may be seen in FIGS. 14A-B.

Figure 13:
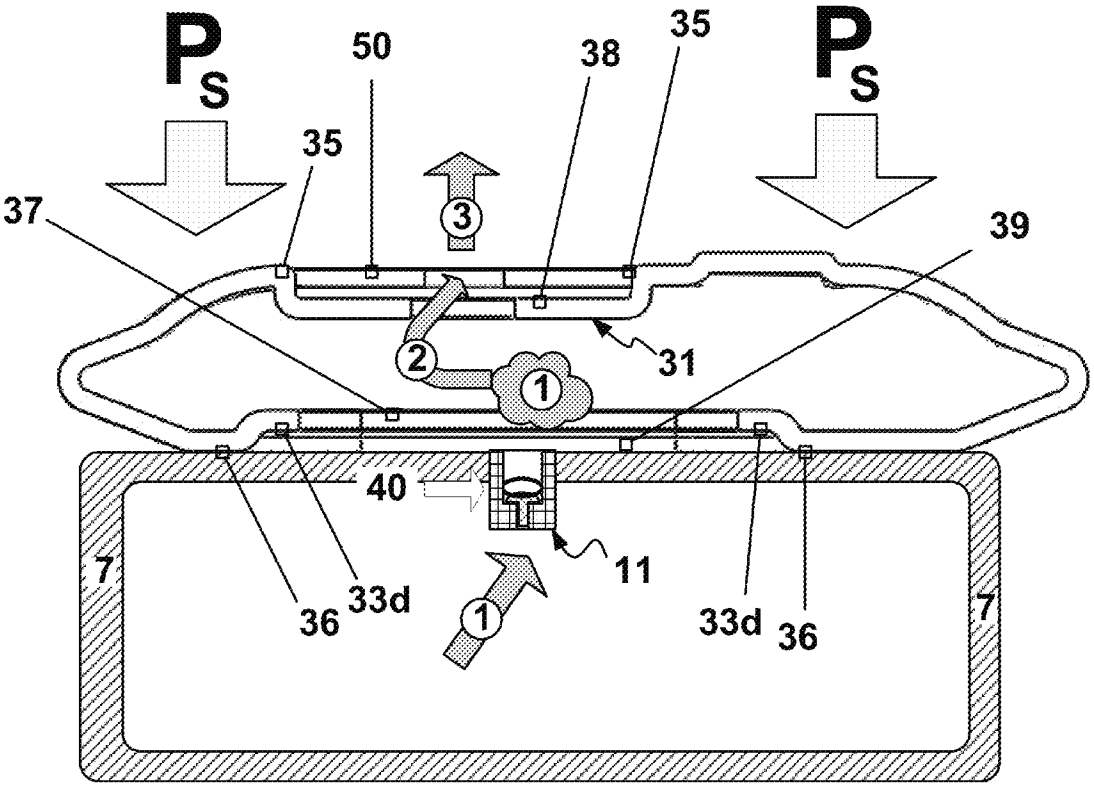
FIG. 13 illustrates an exemplary operation of a vacuum air-removal mechanism according to other exemplary embodiments of the present invention.

In accordance with the exemplary aspects of the present invention illustrated by FIG. 13, an exemplary chamber 30 may be operated diagrammatically as shown. In an exemplary vacuum chamber 30, an exemplary inside surface 34*a*, 34*b*, and/or 34*c* may enclose a volume between about 10 cubic centimeters and about 15 cubic centimeters. According to the illustrative embodiment of FIG. 13, an exemplary vacuum chamber 30 may be adhered to container 7 at junction surfaces 36 by adhesives or mechanical/chemical coupling mechanisms known to those skilled in the art and previously described. Additionally, junction surfaces 36 of vacuum chamber 30 may be placed upon container 7 so that any vacuum created as a result of vacuum chamber 30 operation is substantially maintained. As illustrated, a volume of gas "1" may be evacuated from one-way valve 40 of container 7 by application of a force $P_S$ on the upper surface section 33*a* of vacuum chamber 30. This may be achieved by having a force $P_S$ applied to the vacuum chamber 30 to compress its internal volume, followed by release of force $P_S$ so that vacuum chamber 30 may regain its original volume. Accordingly, the release of force $P_S$ may allow vacuum chamber 30 to create a vacuum above one-way valve 40 of container 7 and by doing so draw in a volume of gas 1 from within container 7.

According to the illustrative embodiment of FIG. 13, a vacuum seal may exist between junction surfaces 36 and container 7. Further, the surface geometry of vacuum chamber 30 may be such that steps 33*d* form a nozzle 39 to channel gas 1 from one-way valve 40 to passageway 37 of vacuum chamber 30. In an exemplary embodiment, nozzle 39 may increase the velocity of the gas 1 traveling out of container 7 so as to more quickly evacuate the container 7 during the expansion of vacuum chamber 30. In another exemplary embodiment, nozzle 39 may be small in volume so as to create a pressure gradient from one side of passageway 37 to another side, thereby facilitating greater flux of gas 1 from the side closest to container 7 to the other side within vacuum chamber 30. In another embodiment, the vertical displacement caused by an exemplary nozzle 39 between surface of storage container 7 and passageway 37 may enable play between passageway 37, valve 40, and the surface of container 7 found between junction points 36 of vacuum chamber 30. Accordingly, an exemplary nozzle 39 may prevent obstruction to gas flow from the container 7 to vacuum chamber 30.

As illustrated by FIG. 13, gas 1 obtained from a storage container 7 and located in vacuum chamber 30 may be expelled by application of forces $P_S$ on one or more portions of upper surface section 33*a* so as to cause deflection in at least an intermediary section, such as middle surface section 33*b*. An exemplary intermediary section may contain sides that form an acute angle with respect to one another or otherwise join at a common vertex pointed either inwardly or outwardly from the center of vacuum chamber 30. An exemplary intermediary section may be illustrated as middle section 33*b*, but other such sections consistent with the above may also be utilized as well. Additionally, forces $P_S$ may cause deflection to a lower surface section 33*c* or a combination of a lower surface section and an intermediary section, such as middle surface section 33*b*. While forces $P_S$ may be illustrated as two separate forces, one force $P_S$ may be applied to the upper surface section 33*a*. Once applied, gas 1 may travel via one or more exit paths 2 through the hole 31 in the pocket 38 of upper chamber section 33*a*. An exemplary exit stream 3 may flow from valve 50 atop pocket 38. In another embodiment, an exemplary exit stream 3 may flow from valve 50 using the geometries of recesses/arches 35 just before valve 50. While the illustrative operation of an exemplary vacuum chamber 30 may be shown in FIG. 13, the operative steps and sequence of activities illustrated are not in any required order and may take place in any manner needed to remove a gas from an exemplary container.

In an exemplary operation of an exemplary vacuum chamber 30, the exemplary vacuum chamber 30 may be placed on a food storage containment unit, e.g., a bag with a one-way flow valve or a plastic container with a one-way flow valve, and by repeated application of pressure to the chamber 30, evacuate air from the unit creating a vacuum therein. Such an application of the exemplary vacuum chamber 30 may be to prevent freezer burn or extend the life of perishable goods. Yet another further example for use of an exemplary vacuum chamber 30 is to maintain biologics such as tissue samples and pathology specimens. In still another embodiment, an exemplary vacuum chamber 30 may be used to encompass a valve on a wound dressing and be used to evacuate air from spaces beneath the dressing by repeat application of forces to the surface of the vacuum chamber 30. According to this exemplary embodiment, a vacuum chamber 30 may be utilized to aid in the healing of chronic or deep wounds to mammals and other animals.

Many further variations and modifications will suggest themselves to those skilled in the art upon making reference to the above disclosure and foregoing illustrative embodiments, which contain parts that are interchangeable and are given by way of example only, and are not intended to limit the scope and spirit of the invention described herein.

The invention claimed is:

1. A device, comprising:

an upper section having a unidirectional flow valve disposed therein;

a lower section having at least one surface configured for adhering to a container comprising a container unidirectional flow valve, the lower section also having a passageway through its thickness shaped to circumscribe the container unidirectional flow valve; and a middle section comprised of a plurality of walls, of which two of the plurality are joined at a substantially acute angle, the middle section coupling the upper section to the lower section to form a cavity between the unidirectional flow valve and the passageway.

2. The device of claim 1, wherein the cavity is substantially hexagonal in cross-section.

3. The device of claim 1, wherein the cross section of the middle section is less than the cross section of one of the lower section and the upper section.

4. The device of claim 1, wherein the lower section has at least one elevated surface proximal to the passageway and distal to the middle section.

5. The device of claim 1, wherein the at least one surface on the lower section is equally distributed about the passageway.

6. The device of claim 1, wherein the at least one surface on the lower section is equally distributed about the lower section.

7. The device of claim 1, wherein the unidirectional flow valve is a laminate-type valve.

8. The device of claim 1, wherein the upper section has a channel connecting the cavity to the unidirectional flow valve.

9. The device of claim 1, wherein the middle section further includes walls that are joined together at substantially non-acute angles.

10. The device of claim 1, wherein the material making up the upper, middle, and lower sections is the same.

11. The device of claim 1, wherein at least one of the upper, middle, and lower sections is made of an elastomer.

12. A gas evacuation system, comprising:

a chamber comprising at least one portion with a substantially hexagonal profile, the chamber having a unidirectional flow valve, a passage through the at least one portion, and at least one elastically resilient fold coupling the unidirectional flow valve to the passageway; and a storage container with a unidirectional flow valve disposed about its surface, wherein the chamber passageway is configured to couple about the unidirectional flow valve on the surface of the storage container so as to substantially form a vacuum seal about the storage container unidirectional flow valve.

13. The system of claim 12, wherein said elastically resilient fold is made out of an elastomer.

14. The system of claim 12, wherein said storage container is a storage bag.

15. The system of claim 12, wherein said storage container stores substantially solid food.

16. The system of claim 12, wherein the unidirectional flow valve is disposed over the passageway so that it is aligned with the unidirectional flow valve of the storage container.

17. The system of claim 12, wherein the chamber is substantially rectangular as viewed when facing the passageway.

18. The system of claim 12, wherein the chamber adheres to the storage container via an adhesive.

19. The system of claim 12, further comprising a pocket coupling the unidirectional flow valve to the elastically resilient fold.

20. The system of claim 12, wherein at least one of the at least one elastically resilient folds is at an acute angle.

* * * * *